United States Patent [19]

Nowakowski

[11] 4,337,402

[45] Jun. 29, 1982

[54] MOTION SENSOR SWITCH AND CIRCUIT FOR USE THEREWITH

[75] Inventor: Victor A. Nowakowski, Des Plaines, Ill.

[73] Assignee: Mattel, Inc., Hawthorne, Calif.

[21] Appl. No.: 254,021

[22] Filed: Apr. 9, 1981

[51] Int. Cl.[3] ..... H01H 35/14

[52] U.S. Cl. ..... 307/121; 200/61.45 R

[58] Field of Search ..... 307/121; 200/61.45 R

[56] References Cited

U.S. PATENT DOCUMENTS 3,673,362 6/1972 Carlson et al. ..... 200/61.45 R 4,287,765 9/1981 Kreft ..... 307/121 X

*Primary Examiner*—Michael L. Gellner

*Attorney, Agent, or Firm*—John G. Mesaros; Max Shirk; Ronald Goldman

[57] ABSTRACT

A motion sensing switch and circuit associated therewith, the switch including a cylindrical non-conductive sleeve housing having circumferentially spaced parallel rib contacts etched on the interior thereof, all the rib contacts being electrically connected together for providing a first switch member with a conductive ball shaped member resiliently suspended in spaced proximate relation to the contact, the conductive member being electrically connected for providing a second switch contact with the electrical circuit providing a pulsed output proportional to the number of rib contacts wiped by the conductive ball during movement of the sensor.

16 Claims, 6 Drawing Figures

MOTION SENSOR SWITCH AND CIRCUIT FOR USE THEREWITH

BACKGROUND OF THE INVENTION

The background of the invention will be discussed in two parts:

1. Field of the Invention

This invention relates to motion sensing switches and more particularly to a rate sensitive motion switch.

2. Description of the Prior Art

Switches for sensing motion have a wide range of utility, and such switches are employed as accelerometer switch devices for motion detecting devices. Such prior art motion sensing switches are shown and described in the following patents, for example. U.S. Pat. No. 3,001,039 issued to Johnson on Sept. 19, 1961 for an "Omni-directional Inertial Switch" discloses an inertia switch having a cylindrical conductive sleeve with an axially extending rod suspended between non-conductive end caps with a plurality of weights mounted on the rod with coil springs therebetween, and contacts deformable upon movements of the weights to complete an electrical circuit between the contacts and the inner surface of the conductive cylindrical shell.

Another such switch is shown and described in U.S. Pat. No. 2,793,260 issued to Ciosek on May 21, 1957, this switch having a conductive mass generally rectangular in cross-section suspended within a housing at the diagonally opposed corners thereof with the other two corners extending through apertures in the housing, movement of the switch resulting in a closure between the mass and the housing for completing a circuit.

U.S. Pat. No. 3,492,450 issued to Stockdale, et al. on Jan. 27, 1970, for an "Inertia Switch," illustrates another type inertia switch utilizing a conductive housing with switch contacts within the housing being actuated in response to movement of a mass contained within the contacts. Such prior art switches are basically on/off devices, or limited to motion in a particular direction and not readily capable of mass economical manufacture.

Another switch of this vintage is likewise shown and described in U.S. Pat. No. 2,881,276 to Mintz, et al. on Apr. 7, 1959.

It is accordingly an object of the present invention to provide a new and improved motion sensor switch.

It is another object of the present invention to provide a new and improved motion sensor switch of economical and simple design and construction.

It is still a further object of the present invention to provide a new and improved motion sensing switch and circuitry associated therewith for providing a pulse output proportional to the rate of movement of the switch.

SUMMARY OF THE INVENTION

The foregoing and other objects of the invention are accomplished by providing a motion sensor switch having a non-conductive sleeve member with the interior surface thereof having etched thereon a plurality of circumferentially extending parallel spaced contact ribs of conductive material having a conductive interconnecting portion terminating externally of the housing. Opposing ends of the sleeve member are closed by end caps resiliently supporting a conductive mass in spaced proximate relation to the contact ribs, the conductive mass having an electrical connection to the exterior of the housing. Electrical circuits are provided for connection to the two electrical contacts of the switch for providing an output in proportion to the number of contact ribs contacted by the conductive mass during motion of the switch.

Other objects, features and advantages of the invention will become apparent from a reading of the specification when taken in conjunction with the drawings in which like reference numerals refer to like elements in the several views.

BRIEF DESCRIPTION OF THE DRAWINGS

FIG. 3 is a cross-sectional view of an alternate embodiment of the motion sensor switch of FIG. 1;

DESCRIPTION OF THE PREFERRED EMBODIMENT

Figure 1:
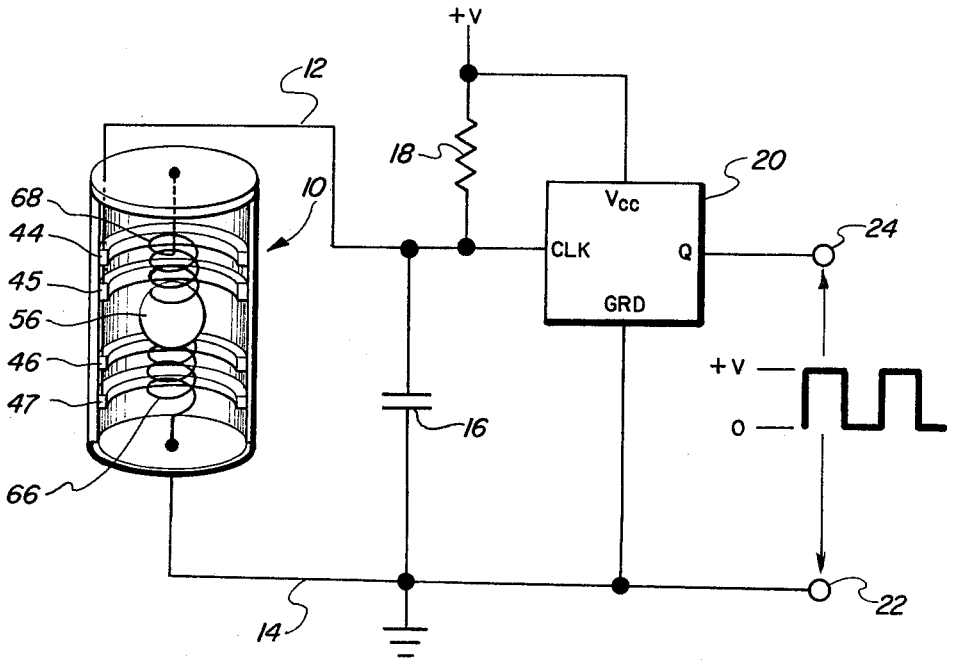
FIG. 1 is a diagrammatic view of the motion sensor switch, and a schematic diagram of the circuitry for receiving the output thereof in accordance with the invention.

Referring now to the drawings and particularly to FIG. 1, there is shown a motion sensor switch generally designated 10 having a pair of output leads 12 and 14 coupled to an electrical circuit. The leads 12 and 14 are coupled across a capacitor 16, one end of which is connected to ground and the other end connected through a resistor 18 to a non-zero source of voltage +V which also provides the power to a flip-flop 20. The ground connection of the flip-flop 20 is connected to ground and the lead 12 from the motion sensor switch 10 is connected to the clock input of flip-flop 20. A pulse output is received between ground terminal 22 and the Q output 24 of flip/flop 20, this pulse output appearing as a squarewave pulse of a frequency determined by the level of activity or motion of the sensor switch 10.

Figure 2:
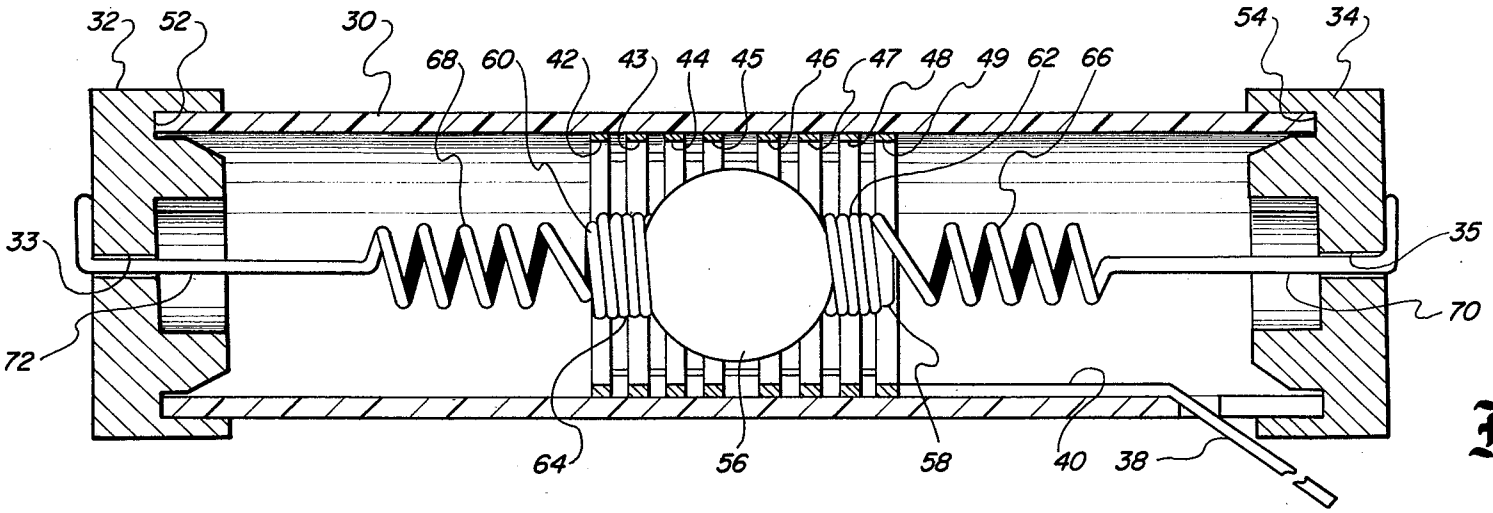
FIG. 2 is a cross-sectional view of a first embodiment of the motion sensor switch of FIG. 1.
Figure 1:
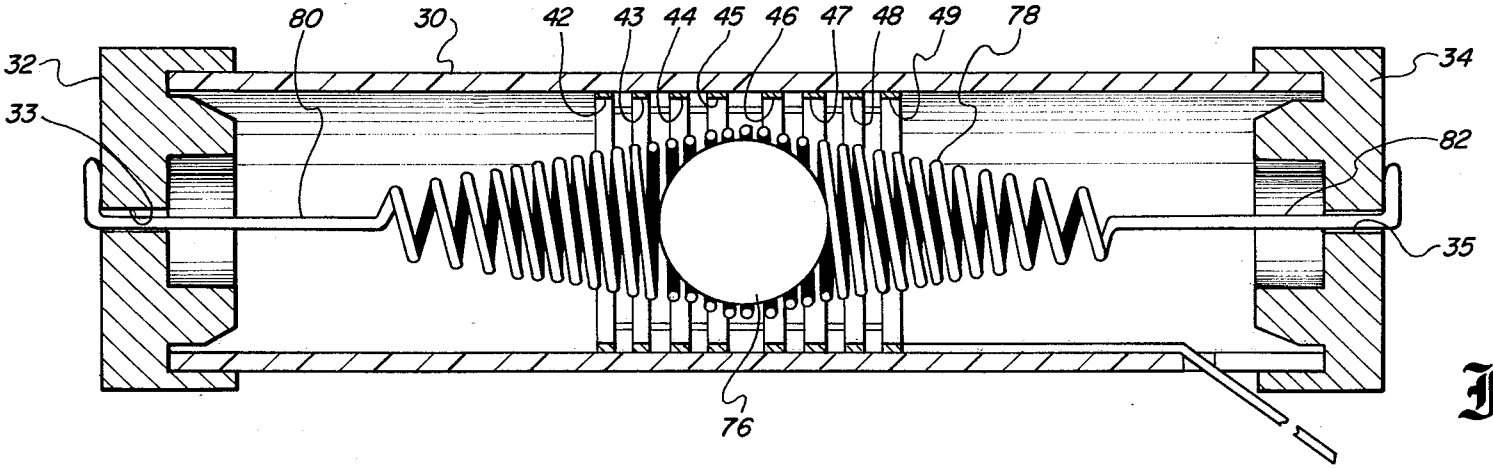

Referring to FIGS. 1 and 2, the motion sensor switch 10 includes a cylindrical housing or outer sleeve 30 formed of a non-conductive material such as Mylar or the like, with the open ends of the sleeve or tube being closed by suitable end caps 32 and 34, the end caps 32 and 34 having centrally disposed apertures 33 and 35 respectively in axial alignment with each other along the longitudinal center line of the sleeve 30.

Figure 4:
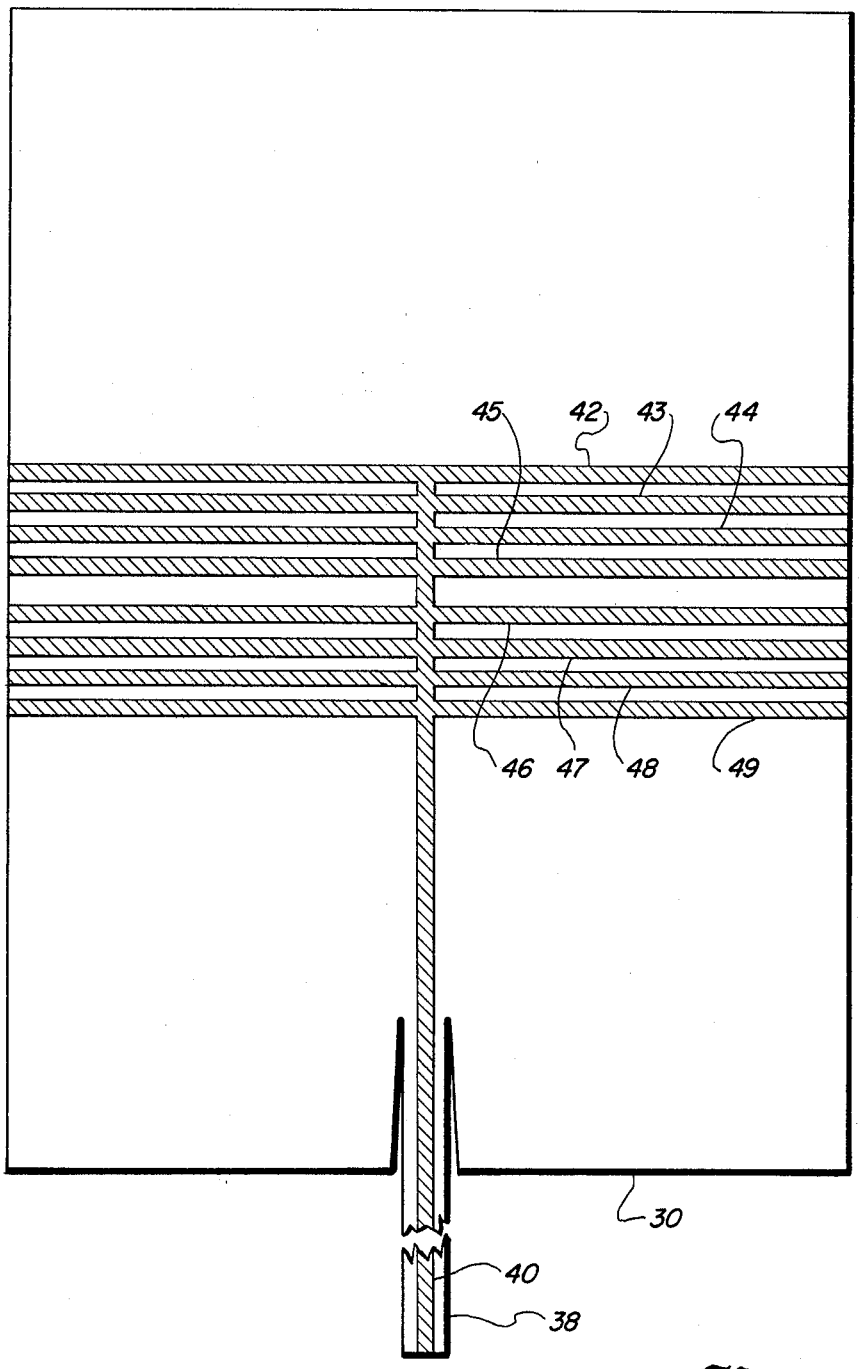
FIG. 4 is a plan view illustrating the conductive rib layout of the sleeve member of the motion sensor switch in a planar form.

By reference also to FIG. 4, the sleeve 30 is initially formed in a planar configuration by techniques employed in printed circuit manufacture, that is the forming of conductive leads in a predetermined configuration on a substrate such as non-conductive Mylar by masking and etching. The Mylar sheet is generally rectangular with typical dimensions being three-quarters of an inch by 0.55 inches with one portion of the sheet depending to form a pigtail 38 for etching thereon the primary conductive lead 40 which terminates externally of the sleeve 30 thus formed. The conductive portion of the printed circuit that remains forms a lattice of parallel spaced contact ribs 42–49 inclusive which, with the sheet 30 rolled into a sleeve or tube are circumferentially disposed within the sleeve 30 to form a contact zone defined by the outer limits of conductive rib 42 and conductive rib 49. It is to be noted that the spacing between the two center contact ribs 45 and 46 is greater than the spacing between other adjacent rib portions.

By reference again to FIG. 2, this planar sheet material is rolled into a tube with the end caps 32 and 34 being configured with annular recesses 52 and 54 respectively for capturing the sleeve 30 thus formed therein. A conductive mass, generally designated 56 has the main body portion thereof spherically formed with diametrically opposed projections 58 and 60 integral therewith. The projections 58 and 60 captively receive thereon first ends 62 and 64 respectively of coil springs 66 and 68 respectively. The springs 66 and 68 are generally identical and provided with axially extending free ends 70 and 72 extending through apertures 35 and 33 respectively with the end portions thereof being bent over externally of the apertures for maintaining the conductive mass 56 in a suspended state generally centrally relative to the axial length of the sleeve 30 and in spaced proximate relation to the surrounding circumferential contact ribs 42–49. By the utilization of conductive spring members 66 and 68 and a conductive mass 56 the terminal end of either spring external to the end cap 32 or 34 may be utilized as one of the contacts of the motion sensor switch 10 thus formed with the other contact being provided by the conductive lead 40 extending outwardly of the sleeve 30 by means of the pigtail portion 38.

During assembly, the springs 66 and 68 are tensioned during insertion for resiliently supporting the conductive mass 56. The motion sensor switch 10 depicted in FIG. 2 has typical overall dimensions of less than one inch in length and approximately three-eighths inch in diameter thus providing a compact economically reproducible motion sensor switch. A motion sensor switch in accordance with the instant invention may conveniently be utilized as a motion detector for a jogging computer such as shown and described in U.S. Pat. No. 3,797,010 or for such devices as exercise recorders of a type similar to that shown in U.S. Pat. No. 4,144,568. The systems of both of these patents utilize a motion sensor. With the motion sensor 10 of the instant invention, and the compactness thereof, it can be conveniently strapped to an arm or leg of the user for detecting activity without providing excess weight or an obtrusive or bulky device.

The motion sensor switch 10 is sensitive to physical movement in three dimensions. Visualizing the motion sensor switch 10 of FIG. 2 in a vertical position, if the conductive mass 56 moves only in a horizontal direction (that is toward the centermost contact rib 45 and 46) then the mass 56 will touch only the adjacent contact rib 45 or 46.

If the sphere or conductive mass 56 moves in a vertical direction, that is along the axial length thereof, there will likewise be some radial movement and during this movement the mass 56 will slide over several contact ribs as it moves up and down within the cylinder or sleeve 30. The spacing between adjacent contact ribs 42–49 is selected so that as the mass 56 slides over adjacent contact ribs, conductive contact will be intermittently made and broken in accordance with the rate of the activity or movement of the sensor 10.

For connection to electrical circuits, with the mass 56 and the springs 66 and 68 being made of conductive material, the free end of either spring 66 and 68 may have electrically secured thereto a conductive lead, which, along with the contact 40 of the pigtail 38 provides the two output leads. By reference to FIG. 1, these leads would correspond to leads 12 and 14 in the schematic diagram. For purposes of limiting the sensitivity of the switch 10 to rapid switch changes, resistor 18 and capacitor 16 essentially act as a low-pass frequency filter at the input to the flip-flop 20, for providing a smoothly varying squarewave output pulse as depicted adjacent the output terminal 24. The flip-flop 20 acts as a toggle, or "divide by two" circuit or device, being alternately set and reset upon switch closures.

FIG. 3 illustrates an alternative embodiment in which the sleeve 30 with the configuration of the contact ribs 42–49 is identical along with the end caps 32 and 34. Instead of an irregularly configured mass 56, a spherical mass 76 is provided which need not necessarily be conductive, the mass 76 being contained within the coils of a single coil spring member 78, of conductive material, formed in a double ended conical configuration with the enlarged portion being configured for receiving therein, in a captive manner, the mass or sphere 76. The ends 80 and 82 of the spring member 78 are then passed through the apertures 33 and 35 of end caps 32 and 34 respectively and then bent over with the spring 78 in tension to support the mass 76 along the axial center line of the tubular housing or sleeve 30. With this configuration, the actual contact with the contact ribs 42–49 is provided by the spring coils having the greatest diameter at the central portion of the spring member 78. The selection between the spring and mass assembly of the embodiment of FIG. 2 or the embodiment of FIG. 3 is a matter of cost and assembly tradeoffs. The concept, however, remains the same for either embodiment, i.e., a suspended mass element cylindrically surrounded by laterally spaced contact ribs.

With the motion sensor switch 10 of either embodiment, depending on the extent of the activity or movement of the motion sensor switch 10, contact will be made or broken at a rate proportional to the physical movement of the switch 10 regardless of the direction of the movement, the switch essentially having three-dimensional sensitivity which, in conjunction with the circuitry shown can be translated into a pulse train having a frequency proportional to the rate of activity or movement of the switch 10 in any direction.

Figure 5:
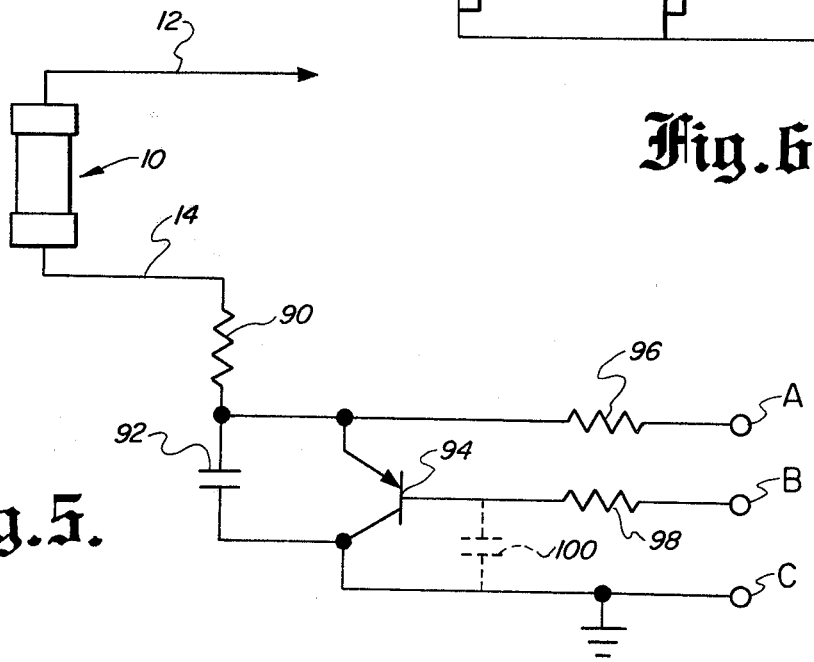
FIG. 5 is an alternate embodiment of circuitry which can be utilized with the motion sensor switch for producing a ramp voltage output representative of the accumulated contact action of the switch.

FIG. 5 illustrates an alternative electrical circuit for utilization with the motion sensor switch 10 in which one lead 12 thereof is connected to a non-zero source of voltage with the other lead 14 thereof being connected through a resistor/capacitor network consisting of resistor 90 and capacitor 92, the capacitor 92 being connected between the emitter to collector path of a PNP transistor 94. A second resistor 96 is coupled between the emitter and a terminal designated A, with a third resistor 98 being coupled between the base and a second terminal designated B. The collector of transistor 94 is connected to the ground terminal C. Shown in dotted lines, a second capacitor 100 may be interconnected between the collector and base of the transistor 94 if desired or needed.

In the circuit of FIG. 5, the time constant is determined by the values of resistor 90 and capacitor 92 with the input impedance being determined by the value of resistors 90 and 96. The terminal A is an output terminal used in conjunction with terminal C for providing the input to other devices while the terminal B is a "reset" input to the transistor 94. Upon contact closure within the motion sensor switch 10 the voltage from the positive source of voltage +V is applied through resistor 90 to charge the capacitor 92 whereupon the voltage appearing between the emitter and collector of transistor 94 builds up until a reset pulse is applied to input terminal B to discharge the charge stored on capacitor 92 through the discharge switch or transistor 94.

Figure 6:
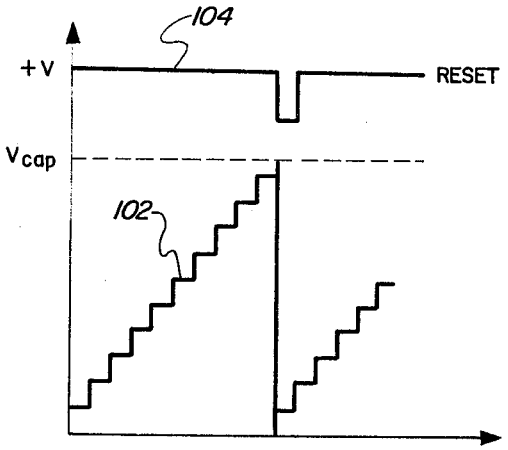
FIG. 6 is a diagrammatic representation of the output of the circuitry of FIG. 5.

This action is illustrated in FIG. 6 where the horizontal scale represents time while the vertical scale represents voltage. The waveform 102 depicts the voltage accumulation across capacitor 92 while the second waveform 104 depicts the input at terminal B to "reset" the circuitry. On each of switch 10 the capacitor 92 charges an increment of voltage producing the ramp voltage waveform 102. This waveform 102 represents the accumulated contact action of the switch 10. This circuitry affectively converts acceleration into velocity and may also be used to determine the time interval between successive peak accumulations using external timing circuitry (not shown). A negative-going pulse applied as shown in waveform 104 to the base of transistor 94 then provides a discharge path for capacitor 92.

Although the second capacitor 100 (shown in dotted lines) may not be necessary, it is shown as an additional discharge extender, if needed, for the particular transistor 94. By appropriate selection of components and timing of application of the reset pulse to the terminal B, the ramp voltage output between terminals A and C can be appropriately regulated for the particular application of the motion sensor switch 10.

In accordance with the present invention, by reference to FIG. 2, for example, the overall length of the motion sensor switch 10 may be approximately 0.83 inches with a diameter of approximately one-quarter inch. The inner diameter of the sleeve 30 is approximately 0.170 inches with a ten to twenty thousandths etching for the conductive ribs. The diameter of the mass or ball 56 will be approximately one hundred thousandths of an inch with the overall construction providing an easily portable non-bulky motion sensor capable of detecting motion in three dimensions while providing outputs indicative of the motion which, when coupled with appropriate electrical circuitry, provides a pulse train or ramp voltage proportional to the frequency of movement of the motion sensor switch 10.

The motion sensor switch 10 has a characteristic behavior which causes the inertial mass or sphere 56 (or 76) to move in a complex three-dimensional manner upon receiving an impulse force. The resulting movement of the mass 56 (or 76) will appear as a decaying sinusoidal function centered about its rest position. The inner walls of the cylinder or sleeve 30 provide the physical restrictions as to its maximal movement in the three-dimensional area with the above-described housing. With this construction, the characteristic behavior of the inertial mass 56 (or 76) is sensed in a binary (on/-off) sampled manner, (utilizing the above-described circuitry) whose pulse widths and total pulse train per impulse force are the transformed result of the sinusoidal function into a non-linear binary time series. By counting the number of switch closures a count proportional to the impulse force is obtained, thus providing a switch 10 which is rate sensitive to the applied force. Although switch 10 has been described herein as a motion sensor, it may likewise be used in applications requiring an accelerometer-like sensor, or generally in any application needing high sensitivity to small forces.

While there has been shown and described a preferred embodiment, it is to be understood that various other adaptations and modifications may be made within the spirit and scope of the invention.

I claim:

1. In a switch device for sensing motion, the combination comprising:

a generally non-conductive sleeve housing member having a plurality of circumferentially extending, spaced, generally parallel contact means on the interior thereof, said contact means being positioned generally intermediate the ends of said housing member;

a switch member configured for being loosely received within said housing member;

means for resiliently suspending said switch member within said housing member in spaced proximate relation to said contact means and longitudinally intermediate the first and last of said contact means, one of said switch member and said suspending means having a peripheral portion configured for engaging said contact means during movement of said switch device and being conductive at least in the area of such engagement; and means coupled to said contact means and to one of said switch member and said suspending means for providing first and second electrical output leads for said switch device for connection to other electrical circuitry.

2. The combination according to claim 1 wherein said switch member has a generally spherically shaped conductive portion.

3. The combination according to claim 1 wherein said generally parallel contact means includes a plurality of conductive rib contact members.

4. The combination according to claim 1 wherein said sleeve housing member is formed from a generally rectangular conductive sheet having etched thereon an array of generally parallel rib contacts and a common longitudinally extending conductive rib for providing access for an external lead.

5. The combination according to claim 1 wherein said switch member includes a generally ball shaped conductive portion, said device further includes end cap members enclosing the open ends of said housing member, and said suspending means includes spring means coupled to said switch member and to the opposing end caps.

6. The combination according to claim 5 wherein said housing member is formed from a generally rectangular non-conductive sheet having etched thereon generally parallel spaced rib contact means.

7. The combination according to claim 1 wherein said switch member is a generally ball-shaped member and said suspending means includes a conductive spring member encircling said switch member.

8. The combination according to claim 1 wherein said switch member includes a conductive member having a generally ball-shaped portion and diametrically opposed integrally formed projections, and said suspending means includes first and second generally identical spring members having the first ends thereof connected to said projections.

9. The combination according to claim 8 wherein said device further includes end cap means closing the open ends of said housing member, and the second ends of said spring members are connected to said end cap means.

10. In a miniature switch device construction, the combination comprising:

a generally rectangular sheet of generally flexible non-conductive material having etched thereon a plurality of generally parallel spaced conductive rib portions, said sheet being configured for forming a tubular housing member;

first and second generally identical end cap members, each of said end cap members having an annular recess for receiving therein one end of the so-formed housing member;

a switch member configured for being loosely received within said housing member;

means for resiliently suspending said switch member within said housing member in spaced proximate relation to said rib portions and longitudinally intermediate the first and last thereof, one of said switch member and said suspending means having a peripheral portion configured for engaging said rib portions during movement of said switch device and being conductive at least in the area of such engagement; and means coupled to said rib portions and to one of said switch member and said suspending means for providing electrical output leads for said switch device for connection to electrical circuitry.

11. The combination according to claim 10 wherein said switch member is a generally ball-shaped member and said means for suspending includes spring means engaging said ball-shaped member and said first and second end cap members.

12. The combination according to claim 11 wherein said ball-shaped member is a generally conductive mass having diametrically opposed projections and said spring means include first and second generally identical spring members having the first ends thereof secured to said projections and the other ends thereof secured to said end cap members.

13. The combination according to claim 11 wherein said spring means include a conductive spring member connected between said first and second end cap members with said ball-shaped member generally encircled by the midportion of said spring member.

14. In a motion sensing system, the combination comprising:

a switch device having a generally tubular housing with a plurality of generally parallel circumferentially extending conductive strips on the interior thereof generally intermediate the ends of said tubular housing;

a switch member resiliently suspended within said housing in spaced proximate relation to said contact means, at least a portion thereof being conductive and engaging one or more of said strips during movement of said switch device; and electronic means coupled to said switch device for generating an output generally proportional to the motion of said switch device.

15. The combination according to claim 14 wherein said electronic means includes a semiconductor device.

16. The combination according to claim 15 wherein said electronic means further includes a resistance-capacitance means and a source of voltage for charging the capacitor thereof upon contact closure of said switch device.

* * * * *